US010632339B2

(12) United States Patent
Chen

(10) Patent No.: US 10,632,339 B2
(45) Date of Patent: Apr. 28, 2020

(54) TREADMILL

(71) Applicant: Yi-Tzu Chen, Taoyuan (TW)

(72) Inventor: Yi-Tzu Chen, Taoyuan (TW)

( * ) Notice: Subject to any disclaimer, the term of this patent is extended or adjusted under 35 U.S.C. 154(b) by 55 days.

(21) Appl. No.: 15/952,295

(22) Filed: Apr. 13, 2018

(65) Prior Publication Data

US 2019/0314674 A1 Oct. 17, 2019

(51) Int. Cl.

| | |
|---|---|
| ***A63B 22/00*** | (2006.01) |
| ***A63B 22/20*** | (2006.01) |
| ***A63B 22/02*** | (2006.01) |
| ***A63B 21/012*** | (2006.01) |

(52) U.S. Cl.

CPC ..... *A63B 22/0046* (2013.01); *A63B 21/0125* (2013.01); *A63B 22/02* (2013.01); *A63B 22/20* (2013.01)

(58) Field of Classification Search

CPC ... A63B 69/0028–0035; A63B 22/02–22/0292
See application file for complete search history.

(56) References Cited

U.S. PATENT DOCUMENTS 641,424 A * 1/1900 Ziebell ..... A63B 22/0023 185/16
4,361,115 A * 11/1982 Pike ..... A01K 15/027 119/700
5,018,722 A * 5/1991 Whitmore ..... A63B 22/02 482/54
5,577,598 A * 11/1996 Schoenenberger ..... A63B 22/0285 198/832.2
8,864,627 B2 * 10/2014 Bayerlein ..... A63B 21/0053 482/2
9,901,767 B2 * 2/2018 Kuo ..... A63B 21/0053
9,956,450 B2 * 5/2018 Bayerlein ..... A63B 21/0053
9,987,516 B1 * 6/2018 Chen ..... A63B 22/0285
10,220,249 B1 * 3/2019 Chuang ..... A63B 22/02
10,238,912 B2 * 3/2019 Chen ..... A63B 22/0221
2003/0130095 A1 * 7/2003 Hellman, Jr. ..... A63B 21/0084 482/54
2010/0022358 A1 * 1/2010 Schwaiger ..... A63B 22/0242 482/54
2012/0184413 A1 * 7/2012 Lo ..... A63B 22/0235 482/54
2012/0302408 A1 * 11/2012 Burger ..... A63B 21/0087 482/54
2016/0144224 A1 * 5/2016 Dalebout ..... A63B 22/02 482/54

(Continued)

*Primary Examiner* — Nyca T Nguyen
(74) *Attorney, Agent, or Firm* — WPAT, PC

(57) ABSTRACT

A treadmill includes a base frame, a treadmill belt, a plurality of bearing wheels, a bearing frame, and a limiting frame. The treadmill belt is rotatably installed on the base frame. The bearing wheel is mounted on an inner surface of the treadmill belt. Each bearing wheel is inclined with respect to a horizontal plane, and the bearing frame and the limiting frame are both mounted on the base frame. The bearing frame supports the bearing wheels of the upper section of the treadmill belt. The limiting frame is disposed on one side of the bearing wheel and abuts the bearing wheel. The treadmill has the advantages that the friction between the limiting frame and the bearing wheels can be reduced and can avoid sudden stop or sticking.

9 Claims, 4 Drawing Sheets

(56) References Cited

U.S. PATENT DOCUMENTS

| | | | | |
|---|---|---|---|---|
| 2016/0166877 | A1* | 6/2016 | Cei | A63B 22/02 482/54 |
| 2016/0367851 | A1* | 12/2016 | Astilean | B62K 7/00 |
| 2017/0043209 | A1* | 2/2017 | Walstead, Jr. | A63B 22/0285 |
| 2017/0182356 | A1* | 6/2017 | Cei | A63B 21/008 |
| 2017/0312566 | A1* | 11/2017 | Chang | A63B 22/0285 |
| 2018/0001134 | A1* | 1/2018 | Bayerlein | A63B 21/0058 |
| 2018/0111018 | A1* | 4/2018 | Lee | A63B 22/0285 |
| 2018/0140896 | A1* | 5/2018 | Chen | A63B 22/0285 |
| 2018/0264315 | A1* | 9/2018 | Chen | A63B 22/0221 |
| 2019/0168067 | A1* | 6/2019 | Bates | A63B 22/0285 |
| 2019/0217182 | A1* | 7/2019 | Kueker | A63B 71/0054 |

* cited by examiner

TREADMILL

BACKGROUND OF THE INVENTION

1. Field of the Invention

The present invention relates to fitness equipment, especially to a treadmill.

2. Description of the Prior Arts

A treadmill is commonly used fitness equipment which usually comprises a base frame, a treadmill belt, a plurality of bearing wheels, and a bearing frame. The treadmill belt is looped around and is mounted on the base frame, and is divided into an upper section, a lower section, and two end sections. The bearing wheels are mounted on an inner surface of the treadmill belt. The bearing frames are mounted on the base frame and support the bearing wheels on the upper section of the treadmill belt. In this way, the user can walk or run on the upper section of the treadmill belt to achieve the effect of exercise.

However, in a conventional treadmill, the bearing wheels are usually disposed vertically. In other words, an axle of the bearing wheel is horizontal, so that the bearing wheel can withstand larger force. However, the vertically disposed bearing wheel cannot withstand a lateral force. When the user walks or runs, it will inevitably cause a lateral force to the treadmill belt, such that the lateral force easily causes the treadmill belt to deviate in direction.

Some treadmills further provide a limiting member to abut and limit sidewalls of the bearing wheels and the treadmill belt, which may increase the resistance of the treadmill belt when the treadmill belt rotates, thereby making it difficult for the treadmill belt to maintain a constant rotation resistance. The limiting member also generates friction with the sidewalls of the bearing wheels or the sidewall of the treadmill belt, which is prone to wear and noise easily. Moreover, when the friction is too large, the treadmill belt may be stuck and result in a sudden stop, which may cause the user to fall down and is a certain safety risk.

SUMMARY OF THE INVENTION

The main objective of the present invention is to provide a treadmill that can avoid treadmill belt deviation and can reduce the friction of the bearing wheels to avoid noise, wear, and sudden stop.

The treadmill comprises a base frame, a treadmill belt, multiple bearing wheels, a bearing frame, and a limiting frame. The treadmill belt is rotatably mounted on the base frame, is capable of being rotated around the base frame in circulation, is a loop, and includes an upper section, a lower section, and two end sections. Each end section is connected between a respective one of two ends of the upper section and a respective one of two ends of the lower section. The bearing wheels are mounted on an inner surface of the treadmill belt, and each of the bearing wheels is inclined relative to a horizontal plane. The bearing frame is mounted on the base frame, corresponds to the bearing wheels, and supports the bearing wheels of the upper section of the treadmill belt. The limiting frame is mounted on the base frame, is disposed on sides of the bearing wheels, and is capable of abutting wheel surfaces of the bearing wheels to limit the treadmill belt from moving transversely relative to the base frame.

The bearing wheels are inclined relative to a horizontal plane, and the limiting frame abuts wheel surfaces of the bearing wheels to limit lateral movement relative to the base frame of the treadmill belt, thereby preventing the treadmill belt from deviation. In addition, the limiting frame abuts the wheel surfaces of the bearing wheels, which avoids affecting the normal rotation of the bearing wheels. Therefore, the friction between the limiting frame and the bearing wheels are reduced, thereby maintaining a constant rotation resistance of the treadmill belt. As a result, the sudden stop and belt sticking are effectively eliminated, which guarantees the safety of use, and can effectively extend the service life.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
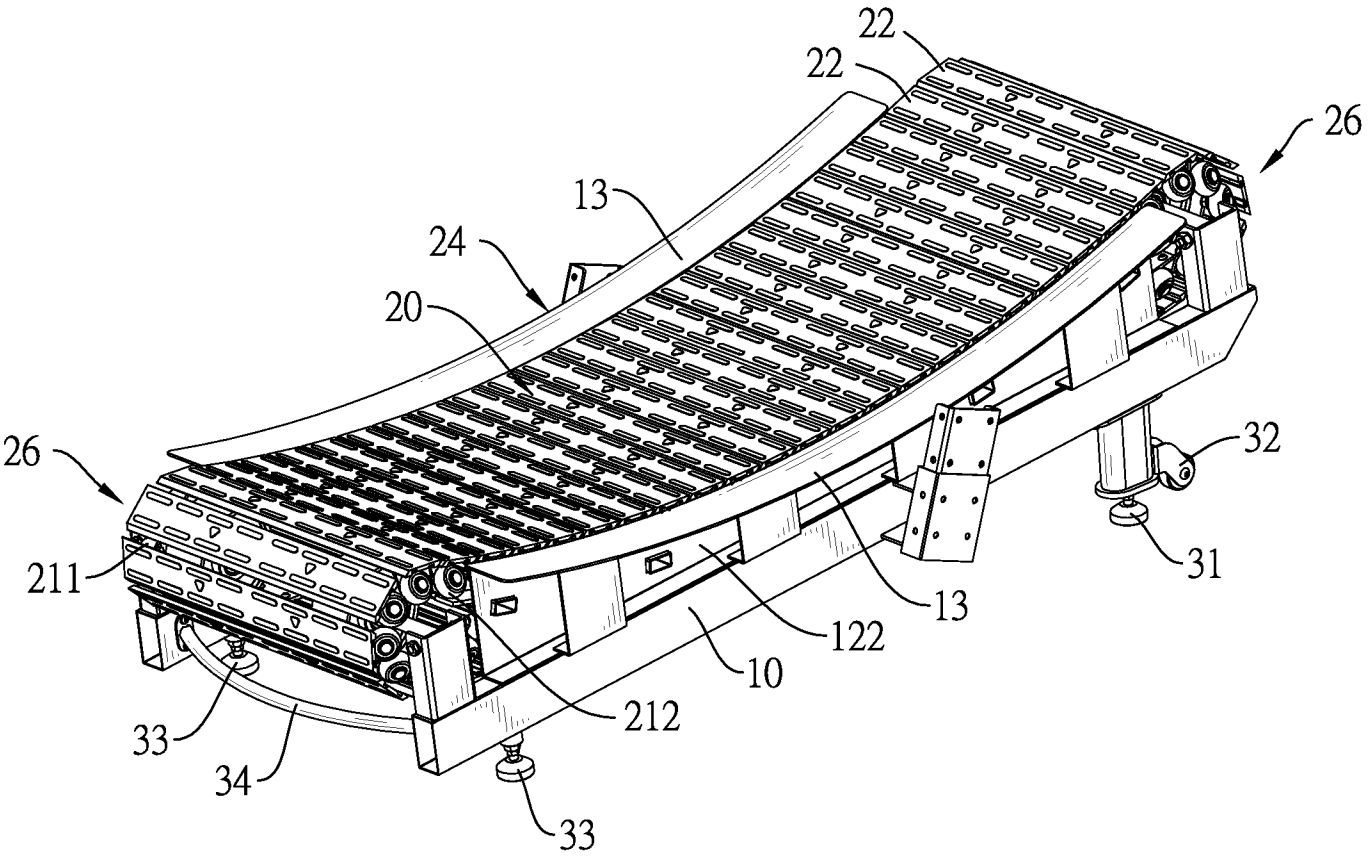
FIG. 1 is a perspective view of a treadmill in accordance with the present invention.
Figure 2:
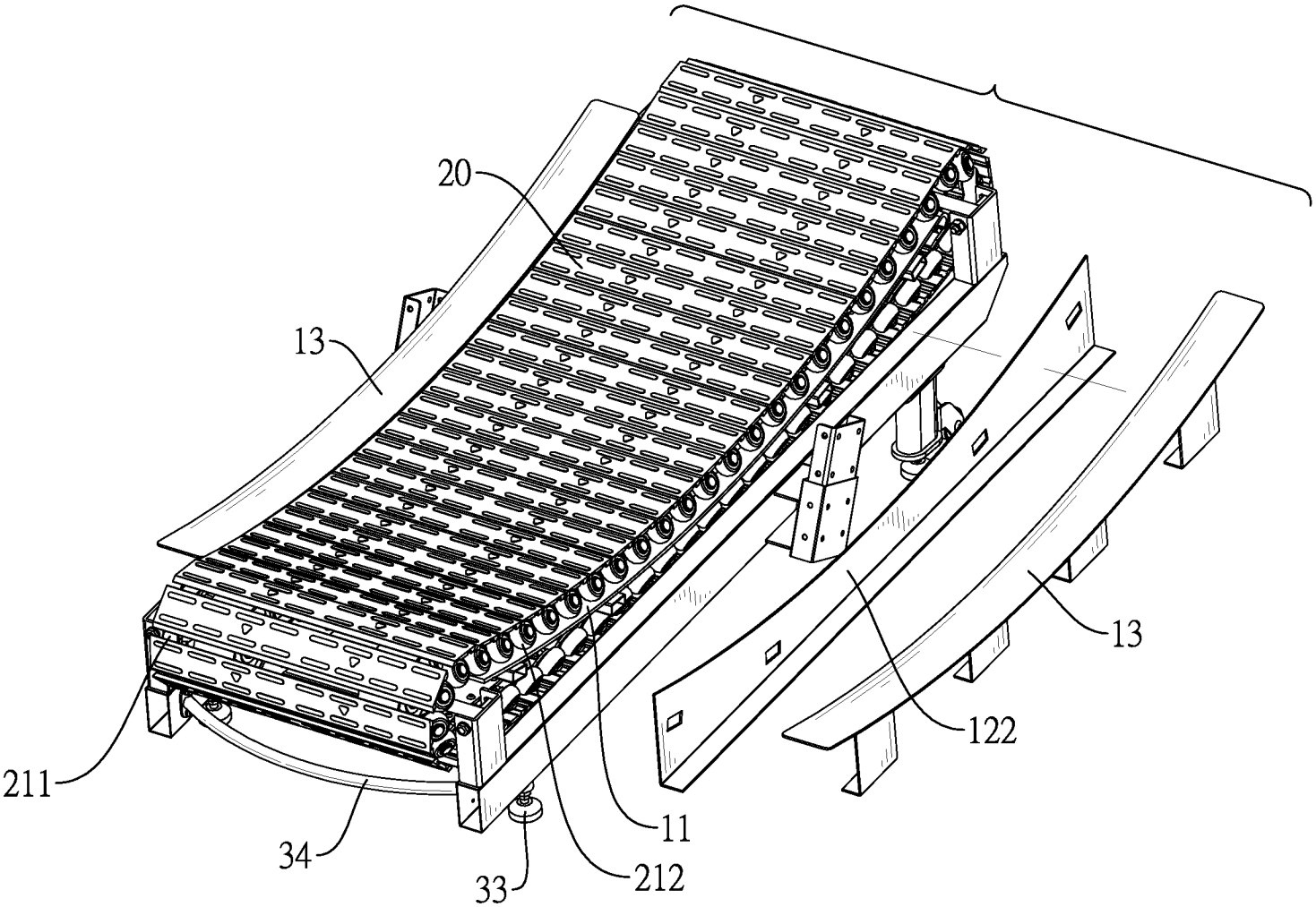
FIG. 2 is an exploded perspective view in partial section of the treadmill in FIG. 1.

With reference to FIGS. 1 to 4, a treadmill in accordance with the present invention comprises a base frame 10, a treadmill belt 20, multiple bearing wheels 211, 212, a bearing frame 11, and a limiting frame 12.

The treadmill belt 20 is mounted on the base frame 10. The treadmill belt 20 is a loop and comprises an upper section 24, a lower section 25, and two end sections 26. The upper section 24 and the lower section 25 are vertically spaced apart. The two end sections 26 are respectively disposed in a front portion and a rear portion of the treadmill belt 20, and each of the two end sections 26 is connected to a respective one of two ends of the upper section 24 and a respective one of two ends of the lower section 25. Therefore, the upper section 24, the lower section 25, and the two end sections 26 are connected to each other to form the looped treadmill belt 20. To be specific, the upper section 24 of the treadmill belt 20 does not strictly refer to a specific part of the treadmill belt 20 because the treadmill belt 20 can be rotated in circulation. Therefore, the various parts of the treadmill belt 20 would serve as the upper section 24 of the treadmill belt 20 in sequence for the user to walk or run when the treadmill belt 20 rotates.

The bearing wheels 211, 212 are mounted on an inner surface of the treadmill belt 20, and each of the bearing wheels 211, 212 is inclined relative to a horizontal plane. In other words, when the present invention is placed on the ground, the bearing wheels 211, 212 are inclined.

The bearing frame 11 is mounted on the base frame 10, corresponds to the bearing wheels 211, 212, and supports the bearing wheels 211, 212 on an inner surface of the upper section 24 of the treadmill belt 20.

The limiting frame 12 is mounted on the base frame 10 and is located on sides of the bearing wheels 211, 212 to abut wheel surfaces of the bearing wheels 211, 212 to limit the treadmill belt 20 from moving transversely relative to the base frame 10.

Since the bearing wheels 211, 212 are inclined and the limiting frame 12 abuts the wheel surfaces of the bearing wheels 211, 212, a lateral movement of the treadmill belt 20 relative to the base frame 10 is limited, thereby effectively avoiding deviation of the treadmill belt 20. The limiting frame 12 abuts the wheel surfaces of the bearing wheels 211, 212, so the normal rotation of the bearing wheels 211, 212 are not affected and the limiting frame 12 is capable of effectively reducing the friction between the bearing wheels 211, 212 and the limiting frame 12. Therefore, the aforementioned structure is beneficial to maintain a constant rotation resistance during the circulative rotation of the treadmill belt 20, avoids sudden stop or sticking, effectively guarantees the safety of use, and effectively prolongs the service life.

In a preferred embodiment, the bearing wheels 211, 212 comprise a plurality of left bearing wheels 211 and a plurality of right bearing wheels 212. The left bearing wheels 211 are mounted on the left side of the treadmill belt 20 and the right bearing wheels 212 are mounted on the right side of the treadmill belt 20. The limiting frame 12 includes a left limiting frame body 121 and a right limiting frame body 122. The left limiting frame body 121 corresponds to the left bearing wheels 211, and is capable of abutting the wheel surfaces of the left bearing wheels 211 to limit the leftward or rightward movement of the treadmill belt 20 relative to the base frame 10. The right limiting frame body 122 corresponding to the right bearing wheels 212 is capable of abutting the wheel surfaces of the right bearing wheels 212 to limit the leftward or rightward movement of the treadmill belt 20 relative to the base frame 10. In addition, the left limiting frame body 121 and the right limiting frame body 122 limit movement of the treadmill belt 20 from opposite directions. In a preferred embodiment, the bearing frame 11 is vertically connected to the limiting frame 12, thereby facilitating simplification and low cost in production, but it is not limited thereto.

In this way, the treadmill belt 20 can ensure uniform force, and can effectively increase a vertical force and a lateral offset force that the treadmill belt 20 can withstand, thereby improving the stability of the present invention and facilitating ease in assembly and use. The left limiting frame body 121 and the right limiting frame body 122 limit movement of the treadmill belt 20 from opposite directions, so that the deviations of the treadmill belt 20 to the left and the right can be avoided. Of course, in actual application, the left limiting frame body 121 and the right limiting frame body 122 also can be made into one piece. The arrangement of bearing wheels 211, 212 can also be flexibly adjusted as needed, but is not limited to the above.

In a preferred embodiment, the left limiting frame body 121 corresponds to the left bearing wheels 211 and is capable of abutting the wheel surfaces of the left bearing wheels 211 to limit the treadmill belt 20 from moving leftward relative to the base frame 10. The right limiting frame body 122 corresponds to the right bearing wheels 212 and is capable of abutting the wheel surfaces of the left bearing wheels 211 to limit the treadmill belt 20 from moving rightward relative to the base frame 10. In this way, ease and convenience in the assembly can be facilitated. Also the left limiting frame body 121 and the right limiting frame body 122 are capable covering the left bearing wheels 211 and the right bearing wheels 212 respectively. Thus, the bearing wheels 211, 212 can be prevented from being exposed, so as to effectively prevent dusts or other objects from entering or adhering to the bearing wheels 211, 212, thereby effectively reducing the malfunction and ensuring the safety of use.

In a preferred embodiment, the bearing frame 11 is curved and is concave upward. In this way, the user can use his own weight to assist in driving and rotating the treadmill belt 20 without any additional power device. As a result, the present invention has the advantages of simple structure and lower cost, making the present invention more easily accepted to users.

In a preferred embodiment, the base frame 10 is mounted with a plurality of guide wheels 141, 142. The treadmill belt 20 is wrapped around the guide wheels 141, 142 and is capable of rotating in circulation. In this way, the structure is simple, and the treadmill belt 20 can be well supported and kept in shape to maintain normal rotation of the treadmill belt 20.

Further, the guide wheels 141, 142 include at least one front guide wheel 141 and at least one rear guide wheel 142. The front end section 26 of the treadmill belt 20 is wrapped around the front guide wheel 141, and the rear end section 26 of the treadmill belt 20 is wrapped around the rear guide wheel 142, thereby ensuring that the treadmill belt 20 is subjected to uniform force and is easy to assemble and use. In a preferred embodiment, the numbers of the at least one front guide wheel 141 and the at least one rear guide wheel 142 are both two, but not limited thereto. Furthermore, a damping structure may also be mounted between the guide wheels 141, 142 and the base frame 10, whereby the resistance can be adjusted when the treadmill belt 20 is being rotated according to actual conditions of use to suit different needs.

In a preferred embodiment, the treadmill belt 20 includes a plurality of pedals 22 connected to each other in sequence in a loop, and each one of the pedals 22 is connected to two of the bearing wheels 211, 212. In a preferred embodiment, both sides of an inner surface of each of the pedals 22 are respectively mounted with a respective one of the left bearing wheels 211 and a respective one of the right bearing wheels 212. In this way, the overall structure is solid, reliable, and is capable of supporting and limiting the bearing wheels 211, 212. In addition, in a preferred embodiment, the bearing wheels 211, 212 are disposed on the inner surface of the pedal 22 through a bent plate to make the bearing wheels 211, 212 inclined relative to a horizontal plane, so the structure is simple and is convenient to manufacture and assemble. However, the combination between the bearing wheels 211, 212 and the treadmill belt 20 is not limited to the above.

Figure 3:
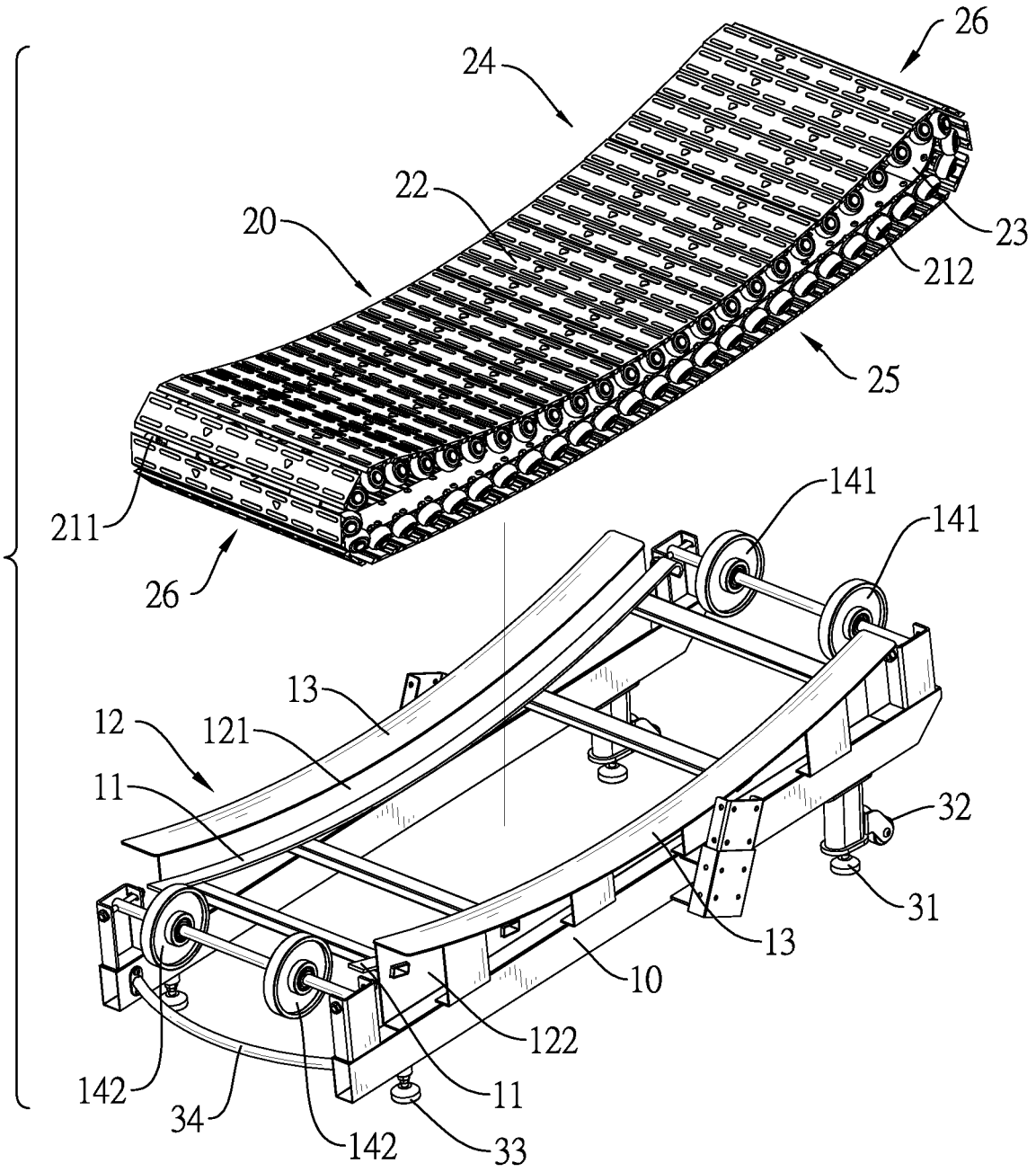
FIG. 3 is an exploded perspective view in another partial section of the treadmill in FIG. 1.

In addition, in a preferred embodiment, the pedals 22 are connected together by an annular flexible connecting band 23 (as shown in FIG. 3). In this way, the aforementioned structure is beneficial to simplify the structure of the pedal 22 so as to facilitate the processing and assembly, and can effectively reduce the cost of production, so that the present invention can be easily used and promoted. Of course, in practical applications, the pedals 22 may also be connected together in other common manners such as pivoting, or the treadmill belt 20 may also adopt other common structures such as a timing belt r, but it is not limited to the above-mentioned.

In a preferred embodiment, at least one front leg 31 is mounted on a front portion of the base frame 10. At least one front wheel 32 is mounted on the at least one front leg 31, and is disposed above a bottom end of the at least one front leg 31. At least one rear leg 33 is mounted on a rear portion of the base frame 10. When in use, the at least one front leg 31 and the at least one rear leg 33 can be used to stabilize the treadmill of the present invention on the ground. When the treadmill needs to be moved to another location, just lift the back of the treadmill to make the front wheel 32 abut the treadmill on the ground, so the treadmill can be conveniently pushed and moved. In addition, the present invention further comprises a handle 34 for the user to grip, lift and push the treadmill. In a preferred embodiment, the numbers of the at least one front leg 31, the at least one front wheel 32, and the at least one rear leg 33 are respectively two, but it is not limited thereto.

Figure 4:
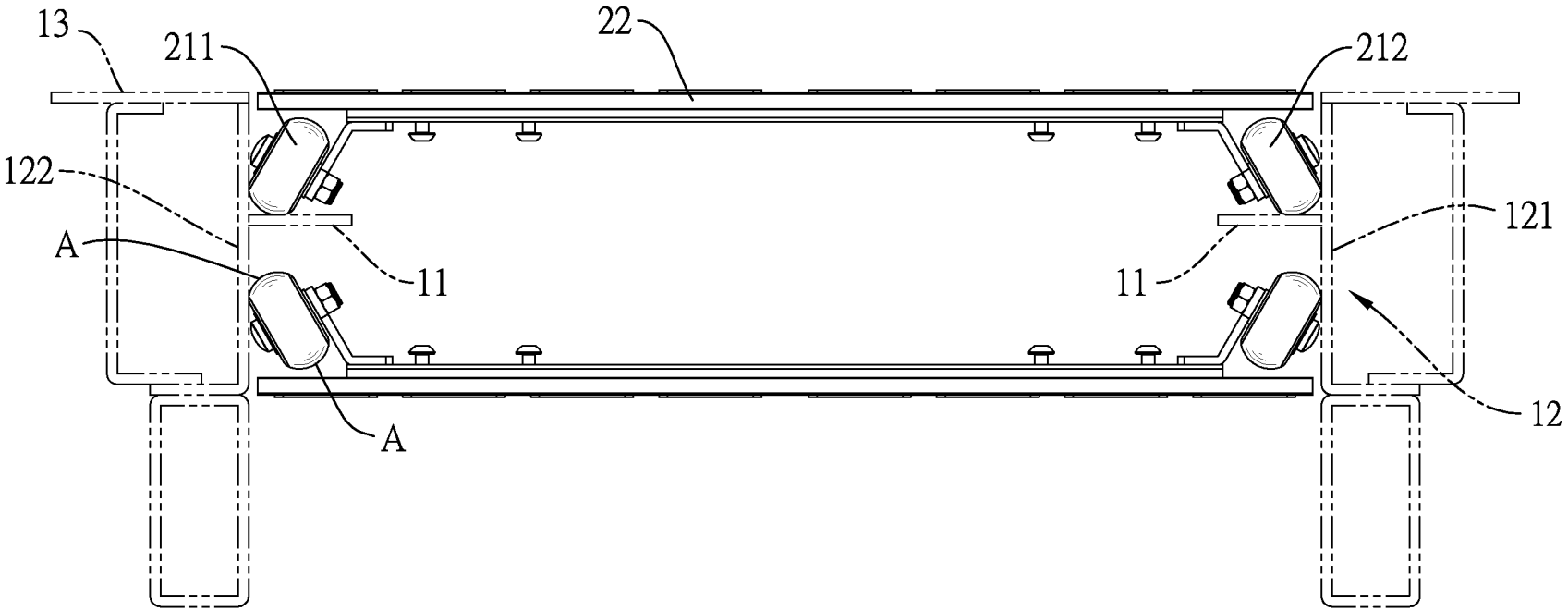
FIG. 4 is an operational end view of the treadmill in FIG. 1, showing a limiting frame and a bearing frame abutting multiple bearing wheels.

In a preferred embodiment, a cross section of a wheel surface A of each of the bearing wheels 211, 212 is arc-shaped (as shown in FIG. 4). Specifically, the cross section refers to a cross section passing through a rotating axis of the bearing wheels 211, 212. In this way, the wheel surface A of each of the bearing wheels 211, 212 is capable of abutting the bearing frame 11 and the limiting frame 12 at the same time and is also easily processed. In practical applications, the wheel surfaces A of the bearing wheels 211, 212 are also capable of adopting other shapes, and are not limited to the above.

In a preferred embodiment, the right side and the left side of the treadmill belt 20 are each mounted with a respective standing table 13. In this way, the standing tables 13 are convenient for users to rest, and are also convenient for users to get on and off the treadmill.

The front, rear, left, and right directions in this invention are for convenience of description only and are not intended to limit the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A treadmill comprising:

a base frame;

a treadmill belt rotatably mounted on the base frame, capable of being rotated around the base frame in circulation, being a loop, and including:

an upper section having two ends;

a lower section having two ends; and two end sections, each one of the end sections connected between a respective one of the two ends of the upper section and a respective one of the two ends of the lower section; and multiple bearing wheels mounted on an inner surface of the treadmill belt, and an axle of each one of the bearing wheels inclined relative to a horizontal plane, wherein the bearing wheels include:

a plurality of left bearing wheels disposed on a left portion of the treadmill belt; and a plurality of right bearing wheels disposed on a right portion of the treadmill belt; and a bearing frame mounted on the base frame, corresponding to the bearing wheels, and supporting the bearing wheels of the upper section of the treadmill belt; and a limiting frame mounted on the base frame, disposed on sides of the bearing wheels, and being capable of abutting wheel surfaces of the bearing wheels to limit the treadmill belt from moving transversely relative to the base frame, wherein the limiting frame comprises:

a left limiting frame body corresponding to the left bearing wheels and being capable of abutting wheel surfaces of the left bearing wheels to limit the treadmill belt from moving rightward or leftward relative to the base frame; and a right limiting frame body corresponding to the right bearing wheels and being capable of abutting wheel surfaces of the left bearing wheels to limit the treadmill belt from moving rightward or leftward relative to the base frame;

wherein the left limiting frame body and the right limiting frame body limit movement of the treadmill belt from opposite directions.

2. The treadmill as claimed in claim 1, wherein the base frame has a plurality of guide wheels, and the treadmill belt is wrapped around the guide wheels to be rotated in circulation.

3. The treadmill as claimed in claim 2, wherein the guide wheels include:

at least one front guide wheel; the end section of the two end sections in a front portion of the treadmill belt wrapped around the at least one front guide wheel; and at least one rear guide wheel; the other end section of the two end sections in a rear portion of the treadmill belt wrapped around the at least one rear guide wheel.

4. The treadmill as claimed in claim 1, wherein the base frame has:

at least one front leg mounted on a front portion of the base frame;

at least one front wheel mounted on the at least one front leg, and disposed above a bottom end of the at least one front leg; and at least one rear leg mounted on a rear portion of the base frame.

5. The treadmill as claimed in claim 4 further comprising a handle mounted on the rear portion of the base frame.

6. The treadmill as claimed in claim 1, wherein the left limiting frame body is disposed on left sides of the left bearing wheels and is capable of abutting the wheel surfaces of the left bearing wheels to limit the treadmill belt from moving leftward relative to the base frame; and the right limiting frame body is disposed on right sides of the right bearing wheels and is capable of abutting the wheel surfaces of the right bearing wheels to limit the treadmill belt from moving rightward relative to the base frame.

7. The treadmill as claimed in claim 1, wherein the bearing frame is curved and is concave upward.

8. The treadmill as claimed in claim 1, wherein the treadmill belt includes:

a plurality of pedals connected with each other in sequence in a loop, and each one of the pedals connected to two of the bearing wheels.

9. The treadmill as claimed in claim 1, wherein a cross section of the wheel surface of each one of the bearing wheels is arc-shaped.

* * * * *